US006534755B1

(12) United States Patent
Paulucci

(10) Patent No.: US 6,534,755 B1
(45) Date of Patent: Mar. 18, 2003

(54) PACKAGING FOR INDIVIDUALLY MICROWAVEABLE PORTIONS OF FOOD ITEMS

(75) Inventor: Jeno F. Paulucci, Duluth, MN (US)

(73) Assignee: Self Serve Foods, Inc., Sanford, FL (US)

( * ) Notice: Subject to any disclaimer, the term of this patent is extended or adjusted under 35 U.S.C. 154(b) by 0 days.

(21) Appl. No.: 09/974,146

(22) Filed: Oct. 9, 2001

(51) Int. Cl.[7] ..... H05B 6/80

(52) U.S. Cl. ..... 219/732; 219/730; 219/725; 99/DIG. 14; 426/107; 426/241

(58) Field of Search ..... 219/730, 732, 219/734, 735, 725, 728, 759; 99/DIG. 14; 426/107, 109, 113, 241, 243, 234

(56) References Cited

U.S. PATENT DOCUMENTS

| | | | | | |
|---|---|---|---|---|---|
| 3,771,713 | A | | 11/1973 | Davidson | 229/27 |
| 4,339,041 | A | * | 7/1982 | Roberts et al. | 206/611 |
| 4,891,482 | A | | 1/1990 | Jaeger et al. | 219/10.55 E |
| 4,911,938 | A | * | 3/1990 | Fisher et al. | 426/107 |
| 5,098,013 | A | | 3/1992 | France et al. | 229/115 |
| 5,106,635 | A | * | 4/1992 | McCutchan et al. | 426/243 |
| 5,214,257 | A | * | 5/1993 | Riskey | 219/732 |
| 5,270,066 | A | * | 12/1993 | Pawlowski | 426/107 |
| 5,445,314 | A | | 8/1995 | Newsome | 229/120.21 |
| 5,585,027 | A | | 12/1996 | Young | 219/730 |
| 6,168,812 | B1 | * | 1/2001 | Paulucci | 426/107 |

* cited by examiner

*Primary Examiner*—Philip H. Leung
(74) *Attorney, Agent, or Firm*—Fredrikson & Byron PA

(57) ABSTRACT

The invention comprises a packaging arrangement for a food item that is cut into segments and positioned on microwaveable susceptor material selected for the size shape and desired cooking properties of he food item to be prepared. The segmented food items can be any shape or size or type of food, however pizza is a preferred food item. The microwaveable susceptor material may have walls surrounding the food item. The food items may be arranged to resemble the whole food item in the package. Each segment of the food item may be individually wrapped so that one or more segments can be save for later use. The segmented food items with associated microwave susceptors are particularly suitable for being dispensed from refrigerated vending machines located in schools, factories, food courts, convenience stores and where microwave ovens are available.

15 Claims, 2 Drawing Sheets

PACKAGING FOR INDIVIDUALLY MICROWAVEABLE PORTIONS OF FOOD ITEMS

BACKGROUND OF THE INVENTION

1. Field of the Invention

This invention relates to microwave susceptor packaged food items and more particularly to packaging individually portions of a whole food item with a related microwaveable susceptor material.

2. Description of the Related Art

A variety of food items has been packaged for sale with wrappers having microwaveable susceptor material included for facilitating microwave heating or cooking of the food items. Many types of microwaveable packaging materials are available for heating at different temperatures and used for different purposes. Some food packaging including microwaveable susceptor material are used for baking and others for making food items crispy. Most prior susceptor packaging has supported or enclosed an entire food item for heating. For example, whole frozen pizzas, situated on a sheet of susceptor material, and over-wrapped with a shrink film are being sold in supermarkets and convenience stores, from which a consumer may purchase the item and place it in a microwave oven for a recommended time to cook the topping and bake the crust. While this style of packaging is convenient, it often happens that a person cannot eat an entire pizza at a sitting resulting in the waste of the uneaten portion.

The prior art also teaches a perforated microwave susceptor material that is designed to be separated into segments approximating the size of the food item to be heated therewith. See U.S. Pat. No. 5,585,027 issued Dec. 17, 1996 to Young. The perforated microwave susceptor material is designed to be torn along the perforations to approximate the size of the food to be heated. However the food item must be cut by the user and placed on the susceptor material prior to placement in the microwave oven. This is inconvenient in that the size of the food item may not match the susceptor material for best results and further, the type of susceptor material may not match the type of cooking needed or produce the correct temperature required for proper cooking.

SUMMARY OF THE INVENTION

The invention relates to packaging for containing a food item, such as a frozen pizza, that has been divided into segments of a size and shape desired, and placed on correspondingly segmented susceptor material, which is of the proper size, shape type allowing all or a predetermined portion of the food item to be microwaved at a given time.

The food item is cut by the manufacturer into segments to be cooked and used at different times, or for faster service, one segment may first be heated in a microwave oven and served while the next portion is being heated. Because less than the whole is being microwaved, less cooking time is required for each segment.

Cutting the food items into segments is also useful for when a consumer only wants to eat a portion of the total purchased food item now and wishes to save the rest for later. The segmented packaging also facilitates sharing of the food item with another person.

The packaging arrangement of the present invention may be such that the segments of food items can be individually wrapped along with its susceptor, or one wrapper may be used to cover all the segments, or each individually wrapped and then over-wrapped as a unitary package.

The segmented food item may be reassembled with respective susceptors to approximate the look of the entire food item before being segmented. Thus in the case of a circular pizza that has been divided into two semicircular halves, the two halves on their individual susceptor trays can be over-wrapped with their diameters close together so that it is immediately recognized as a pizza. The susceptor material would then have adjacent adjoining segments, and if the susceptor material has walls surrounding the food item, wall portions maybe adjacent on adjoining segments.

The shapes of the food items can be rectangular, square, semicircular, or pie shaped. The related susceptor material should approximate the shape and size of the food item and be of the correct type for heating or cooking the food item properly.

OBJECTS OF THE INVENTION

It is an object of the invention to package a food item that has been divided into portions of a convenient size, each portion having its own individually microwaveable susceptor tray.

It is another object of the invention to provide a packaging arrangement for frozen food items to be prepared in a microwave oven in portions so that only a portion need be used at one time.

It is a further object of the invention to provide a packaged, frozen food item to be prepared in a microwave oven that allows a quicker preparation of a smaller segment of a food item for faster serving, and which may be consumed while a next portion is cooking.

It is yet another object of the invention to provide a package in which an entire food item is partitioned into segments with the segments arranged to appear as an easily recognized unitary item.

It is an object of the invention to provide a packaging arrangement having individually wrapped segments of a whole food item, with an accompanying susceptor material, such that the individual segments can be microwave cooked and consumed at different times.

Other objects, advantages and novel features of the present invention will become apparent from the following description of the preferred embodiments when considered in conjunction with the accompanying drawings.

DESCRIPTION OF THE PREFERRED EMBODIMENTS

Food items are frequently packaged for convenient use of the food items enclosed. To this end, it is often desirable to have a large food item cut into segments or portions such that only one segment need be used at a time or so that the segments may be prepared serially instead of all at once. The consumer may wish to eat only a portion of the food item at a given sitting, or may wish to share the food item with another or to prepare a smaller segment of the food item quickly in a microwave oven and serially prepare each item as the previous items are being served. Segmenting the food items may also be necessary when the size of the microwave oven being used is smaller than the otherwise unsegmented food item.

Although the segmented food items may be sold in frozen form from vending machines in schools, factories, or convenience stores having microwave ovens nearby for heating the food items once purchased, the segmented food items, packaged in accordance with the present invention, may also be purchased in stores and taken home for microwave preparation.

For vending machine sales, the food items may be smaller than those purchased for home use. For example a vending machine or convenience store may sell an 8 inch diameter frozen pizza in semicircular or pie shaped segments for microwaving, each segment as an individual serving, whereas a home use version may have a larger size pizza with either more or bigger segments for consumption by several family members.

The segmented food items are placed on individual microwave susceptor material trays of the proper size, shape and type to cook or heat the food item segments to the consistency desired. Many types of microwave susceptor materials are available. Different types are used for browning, crisping, baking, and heating. The temperatures of the susceptor materials vary according to the type of susceptor material used. The susceptor material must be matched to the type of food item to be prepared and the desired result. The types of microwaveable susceptor materials and their various uses in combinations with different food to produce desired results are well understood in the microwave food industry.

The food item segments placed on the susceptor material trays may be precooked, frozen and later reheated on the tray of susceptor material or the food items may be cooked, baked or otherwise prepared on the susceptor material when exposed to microwaves.

Figure 1:
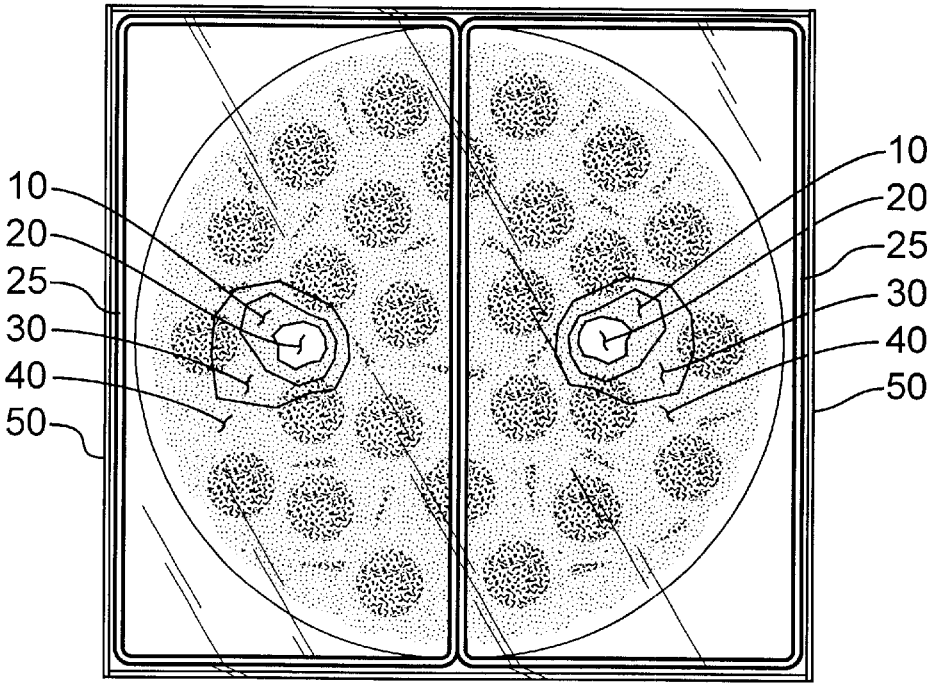
FIG. 1 shows a top view of a circular food item (e.g., a frozen pizza) pre-cut into semicircular segments and placed on a rectangular susceptor material with individually film-wrapped portions and an over-wrapping for the entire food item package.

FIG. 1, shows a first embodiment of the invention, a packaged food item, here a circular pizza, that is segmented into two semicircular segments 10. Each semicircular segment 10 is placed on a rectangular microwaveable susceptor material tray 20 which is selected to be the size, shape and type needed to cook or heat the segmented food item 10 to the desired temperature and consistency.

As shown in FIG. 1, the semicircular pizza segments 10 are placed on respective rectangular trays 20 of microwaveable susceptor material, each tray being slightly larger than the semicircular pizza segments 10. The microwaveable susceptor material tray 20 is selected to provide a crisp crust and heat the ingredients (pizza toppings) on the crust to a desired temperature. The microwaveable susceptor material tray 20 may have side walls 25 to aid in the heating or cooking of the pizza or other segmented food item 10. The pizza or other food item segments 10, in respective trays 20, are arranged proximate each other, to resemble the familiar appearance of the uncut food item. When trays 20 are placed proximate one another, the adjacent wall portions 25 may touch each other.

The individual segmented food items and their associated microwaveable susceptor trays may be wrapped with a transparent film wrapper 30 and held in an, open top, paperboard container 50 so that each may be individually unwrapped and used at different times, if desired. The wrapper 30 may be removed before or after cooking or heating as dictated by the food item and type of heating required for the desired result. Unused, wrapped segments can be kept for later use. Alternatively, the individual food items 10 need not have separate wrappings 30.

A package over-wrapping 40 around the paperboard container 50, segmented food items 10 and their respective microwaveable susceptor material trays 20 and wrappers 30 encloses the entire product sold and may have suitable advertising and other information printed thereon.

Figure 2:
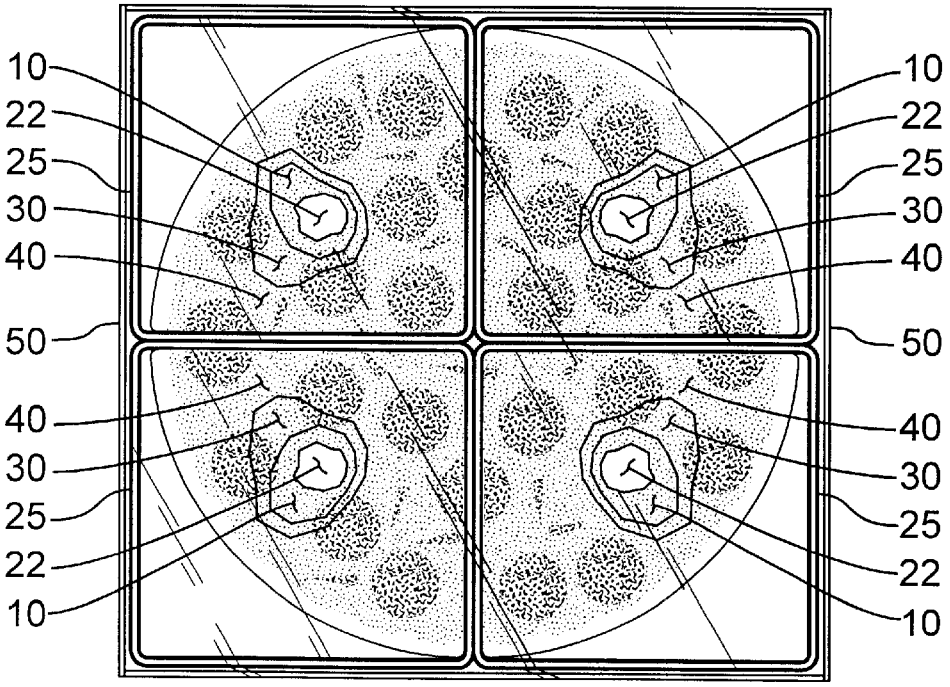
FIG. 2 shows a top view of a circular food item, pre-cut into pie shaped segments individually placed on square susceptor material trays with individually wrapped portions and an over-wrapping for the entire food item package.

In a second embodiment, shown in FIG. 2, the food item 10 is again illustrated as a circular pizza, this time cut into 4 pie-shaped segments. Each pie-shaped food item segment 10 is placed on a square microwaveable susceptor tray 22 which is slightly larger than the pie-shaped food item 10. Each food item segment 10 and its accompanying microwaveable susceptor tray 22 is individually wrapped in wrapper 30 and the segments are assembled in a paperboard container 50 to appear as an easily recognized unsegmented food item. Each microwaveable susceptor tray 22 has walls 25 which may have wall portions adjacent the walls of neighboring trays. A packaging wrapper 40 covers the entire item being sold.

Figure 3:
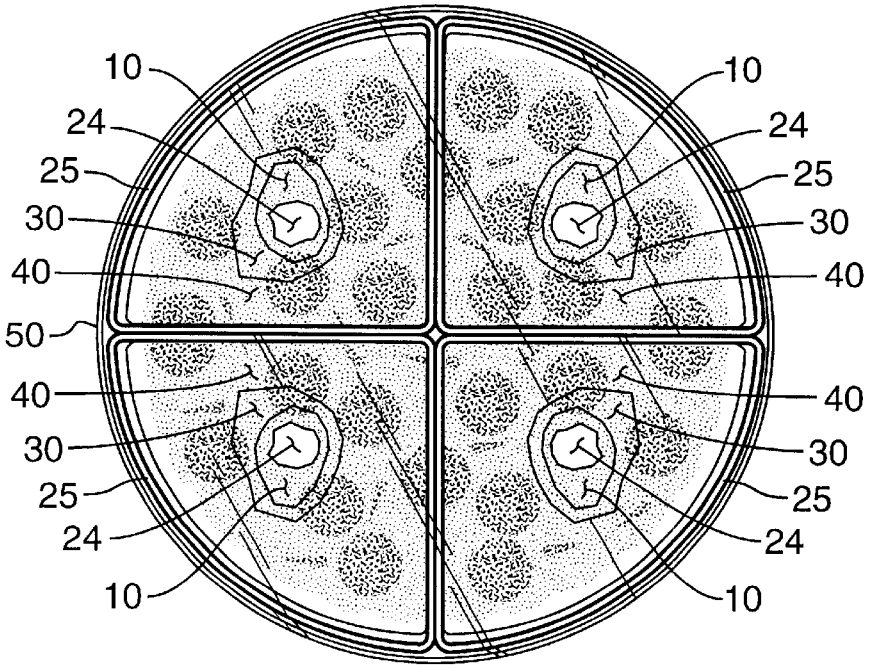
FIG. 3 shows a top view of a circular food item cut into pie shaped segments placed on a pie shaped susceptor material with individually wrapped portions and an over-wrapping for the entire food item package.

In a third embodiment, shown in FIG. 3, the food item 10 is again a circular pizza cut into 4 pie-shaped segments. Each pie-shaped food item segment 10 being placed on a pie-shaped tray 24 of microwaveable susceptor material, which is slightly larger than the pie-shaped food item 10. The pie-shaped microwaveable susceptor tray 24 better approximates the pie-shape of the food item 10 than the square microwaveable susceptor material shown in FIG. 2. Each food item segment 10 and its accompanying microwaveable susceptor material tray 24 is individually wrapped in wrapper 30 and the segments are assembled to approximate an unsegmented food item in a paperboard container 50. Here again the microwaveable susceptor material tray 24 has walls 25 which may have adjacent wall portions. A packaging wrapper 40 covers the entire item being sold. As mentioned, when sold the food item (pizza) may be frozen to preserve freshness.

Figure 4:
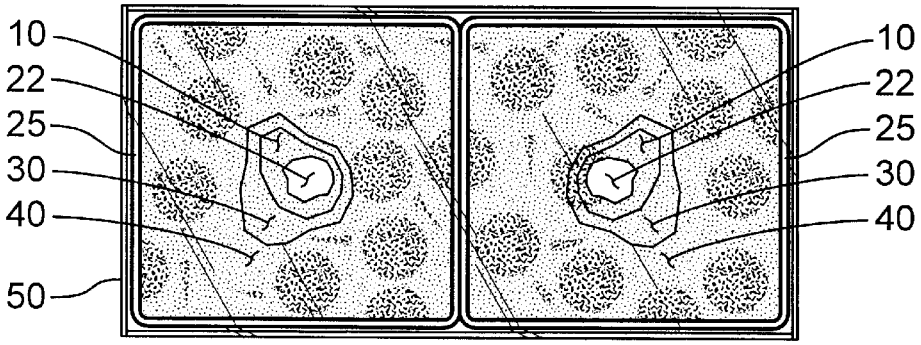
FIG. 4 shows a top view of a rectangular food item cut into two square shaped segments, each placed on a square shaped susceptor material trays with individually wrapped portions and an over-wrapping for the entire food item package.

FIG. 4 shows a food item 10 having a substantially rectangular shape that is segmented into squares, each placed on a square tray 22 microwave susceptor material having walls 25. As before, the food item is packaged to resemble an unsegmented food item and portion of walls 25 of the microwave susceptor material trays 22 may be touching one another before being over-wrapped. Individual wrapping 30 for each food item segment 10 and its tray 22 may be used. Each individually wrapped food item segment 10 may be placed in a paperboard container 50 and a package over-wrapping 40 wrapped around the entire food item sold.

Figure 5:
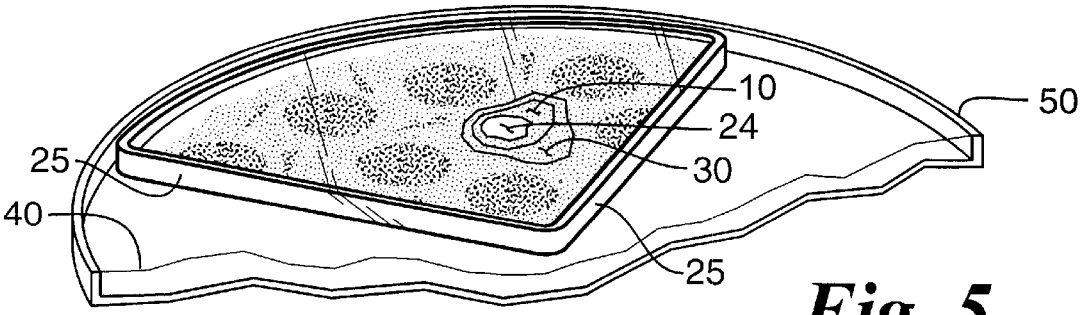
FIG. 5 shows a perspective view of a pie shaped food item segment placed on a pie shaped susceptor material with individually wrapped food item segments and an over-wrapping for the entire food item.

FIG. 5 shows a perspective view of the embodiment shown in FIG. 3 but with only one segment of the segmented food item 10 shown resting on the paperboard container 50. The side walls 25 of the pie-shaped susceptor material tray 24 are clearly seen surrounding the food item 10. The individual wrapping 30 and the package wrapping 40 are also seen.

As is generally known, the temperature to which the food item is frozen, the duration of exposure to microwaves and the power density of the microwaves will affect the preparation time of the food and the effect of the susceptor material on the food. Proper cooking directions are generally included on labeling (not shown) on the packaging for the food item.

The sizes, shapes and types of the food items, their associated microwaveable susceptor materials used and the arrangement of the food items in the package may be varied without departing from the teachings of the examples shown. For example triangular food items may be used with pie shaped microwaveable susceptor materials or visa versa.

Obviously, many modifications and variations of the present invention are possible in light of the above teachings. It is therefore to be understood that, within the scope of the appended claims, the invention may be practiced otherwise than as specifically described.

What is claimed is:

1. A microwaveable food item package comprising:

a food item cut into segments of a predetermined size and shape, an individual microwaveable susceptor material approximating the size and shape of the food item segments, positioned under each of the food item segments, for supporting each segment of the food items individually, and for individually heating each food item segment when exposed to microwaves for a desired result, an open-top container having a bottom and sides, for holding the susceptor and associated food item, a wrapper for individually enclosing each food item segment and its associated microwaveable susceptor material in the container, a package having a bottom and sides for containing the individually wrapped food items, the food item segments assembled adjacently for viewing as if an unsegmented food item is placed in the package, and a transparent package wrapper surrounding the package.

2. A microwaveable food item package as in claim 1 wherein, the food item is a pizza.

3. A microwaveable food item package as in claim 2 wherein, the pizza is circular.

4. A microwaveable food item package as in claim 3 wherein, the pizza is in two semicircular segments.

5. A microwaveable food item package as in claim 3 wherein, the pizza is in four pie shaped segments.

6. A microwaveable food item package as in claim 2 wherein, the pizza is in frozen form in the package prior to exposing the pizza to microwaves.

7. A microwaveable food item package as in claim 2 wherein, the pizza is in two segments.

8. A microwaveable food item package as in claim 2 wherein, the pizza is in four segments.

9. microwaveable food item package as in claim 1 wherein, the food item and the microwaveable susceptor material have two segments.

10. A microwaveable food item package as in claim 1 wherein, the food item and the microwaveable susceptor material have four segments.

11. microwaveable food item package as in claim 1 wherein, the food item segments and the associated microwaveable susceptor material are pie shaped.

12. microwaveable food item package as in claim 1 wherein, the food item segments and the associated microwaveable susceptor material are rectangular shaped.

13. A microwaveable food item package as in claim 1 wherein, the food item segments and the associated microwaveable susceptor material are square.

14. A microwaveable food item package as in claim 1 wherein, the microwaveable susceptor materials have side portions for partially surrounding the food items contained therein.

15. A microwaveable food item package as in claim 14 wherein, the side portions of neighboring food portions are adjacent such that the food items appear as an entire uncut item.

* * * * *